United States Patent [19]

Imbro

[11] 4,120,530

[45] Oct. 17, 1978

[54] INVALID CHAIRS

[76] Inventor: Michael Imbro, 62 Heathcote St., Sandford Hill, Longton, Stoke-on-Trent, England

[21] Appl. No.: 791,411

[22] Filed: Apr. 27, 1977

[30] Foreign Application Priority Data

Apr. 30, 1976 [GB] United Kingdom ..... 17784/76

[51] Int. Cl.[2] ..... A47C 1/02

[52] U.S. Cl. ..... 297/337; 297/115; 297/183; 297/411; 297/416; 297/DIG. 4; 297/DIG. 10

[58] Field of Search ..... 297/115–117, 297/129, 183, 313, 337, 416, 411, DIG. 4, DIG. 10

[56] References Cited

U.S. PATENT DOCUMENTS

| | | | |
|---|---|---|---|
| 2,572,149 | 10/1951 | Hind et al. | 297/313 X |
| 3,158,398 | 11/1964 | Stryker | 297/337 X |
| 3,640,566 | 2/1972 | Hodge | 5/68 X |

*Primary Examiner*—James C. Mitchell

*Attorney, Agent, or Firm*—Neil F. Markva

[57] ABSTRACT

An invalid chair such as a wheelchair for partially disabled paraplegic persons has a pivotally mounted seat mechanically coupled to a movably mounted foot rest structure. By shifting and altering his weight distribution, the chair occupant can depress the foot rest structure from a raised foot-supporting position to a lowered ground-engaging position. At the same time, the seat moves angularly upward and forwardly from a substantially horizontal orientation in a seating support position to a substantially upright back-supporting orientation in a relatively displaced standing support position. Thus, the seat exerts a supporting pressure from behind to the body of the chair occupant and assists his movement in rising from a sitting posture to a standing posture. The arrangement also permits the chair occupant likewise to control reverse movement in changing from a standing posture to a sitting posture by controlling his weight distribution and pressure applied to the foot rest structure. Releasable locking means may be provided to hold the seat in its two extreme positions independently of the weight distribution of the chair occupant.

16 Claims, 3 Drawing Figures

54
18
26
40
75
76
24
25
29
14a
60
43
39
12
14b
16
74
17
52
12
50
51
11
15
32
33
34

INVALID CHAIRS

FIELD OF THE INVENTION

The present invention relates to invalid chairs, especially invalid chairs, such as for example wheelchairs, suitable for paraplegic persons and others who are unable to stand erect without assistance.

BACKGROUND OF THE INVENTION

Up to the present, in order to stand erect such people commonly rely upon an external support aid such as a standing frame which is separate from any chair that they may use. Although such aids may be portable it can be very difficult to transfer from or to a sitting position in a chair. Moreover, such support aids are usually designed to be positioned in front of the user. Consequently this can interfere with or obstruct close approach to a bench or work table for example.

The invention provides a remedy for this difficulty and assists the user of an invalid chair to change between a sitting posture and a standing posture, and to be supported while remaining in a standing posture. Some proposals have been made from time to time for various means, embodied in structure incorporated within the chair for propelling the chair occupant into a standing posture and for holding him upright. In general, however, these prior proposals have usually involved the use of power drive means and of relatively complex and costly structures which have not been well suited for extensive and widespread adoption to meet the needs of many persons who could otherwise benefit from some such means for assistance.

An object of the present invention is accordingly to provide an invalid chair with improved means for assisting the user to change between sitting and standing postures which can be readily operated and controlled by the user himself without need for power drive means and which can be embodied in relatively simple mechanical structures readily incorporated within the chair.

SUMMARY OF THE INVENTION

Broadly, this invention provides an invalid chair having an assembly of body support means operatively interconnected with a foot rest structure. The assembly is controllable, by or in response to an occupant of the chair shifting and altering his weight distribution to vary and control foot pressure applied to said foot rest structure. Thus, supporting pressure is exerted against the body of said chair occupant effective to assist his movement in changing between a sitting posture in the chair and a standing posture on said foot rest structure.

In a specific embodiment an assembly has movably mounted seat member support means and foot rest structures which are operatively interconnected through mechanical motion transmitting means. Thus when the chair occupant in a sitting posture shifts and alters his weight distribution so as to depress the foot rest structure from a raised foot-supporting position into a lowered ground-engaging position, the seat member support means moves forwards in unison from a seating support position to a relatively displaced standing support position. Consequently, the seat member support means exerts supporting pressure from behind against the body of the chair occupant in rising from a sitting posture in the chair to a standing posture on the foot rest structure. Releasable locking means may be provided to hold the seat member support means at least in its forward standing support position when the standing posture is reached.

Preferably, the seat member support means is mounted pivotally to permit forward and upward angular movement from a substantially horizontal orientation in its seating support position to a substantially upright back-supporting orientation in its relatively displaced forwards standing support position. The foot rest structure is also pivotally mounted about a transverse pivotal axis for angular movement between its raised foot-supporting position and its lowered ground-engaging position. The motion transmitting means operatively connecting it to the seat member support means may be provided by a pivotally connected coupling linkage.

Restraining strap means for securing across the body or legs of the chair occupant may also be provided to assist in holding him secure in position on the foot rest structure when erect. Upright handles may be detachably fitted into place on the chair frame to advantageously provide additional steadying support in the standing posture.

In most embodiments, the invalid chairs will be in the form of wheelchairs, but in some cases they may also be in the form of static structures.

BRIEF DESCRIPTION OF THE DRAWINGS

In the accompanying drawings, one form of wheelchair representing a typical specific embodiment of the invention is illustrated by way of example. In these drawings.

DESCRIPTION OF THE SPECIFIC EMBODIMENT

Figure 1:
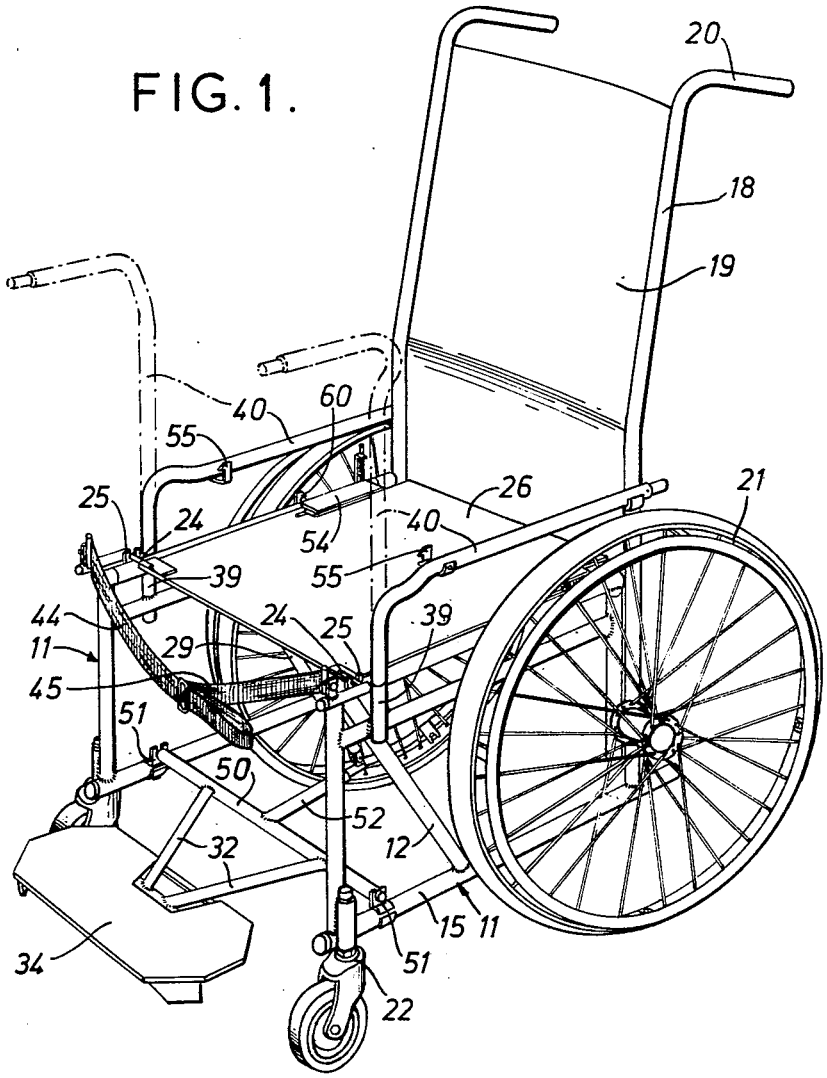
FIG. 1 is a slightly simplified perspective view of the wheelchair.

The wheelchair illustrated in the drawings has a main tubular metal frame of generally conventional design, jointed to permit folding to a collapsed condition for transport and storage. The main metal frame comprises a pair of side frames 11 of substantially rectangular configuration interconnected by intersecting pivotally coupled cross links 12. Each side frame 11 includes upper horizontal side bars **14*a* and 14*b*, lower horizontal side bars 15, a front upright member 16 and a rear upright frame member structure 17. Frame structure 17 has an upwards extension 18 to carry a seat back rest 19 and provides a rear handle 20**.

Adjacent the lower rear corners, the side frames 11, are each adapted to support a conventional mounting for the main wheels 21 of the wheelchair. Adjacent the front end of the lower horizontal side bars 15, conventional castor wheel assemblies 22 are fitted.

Figure 2:
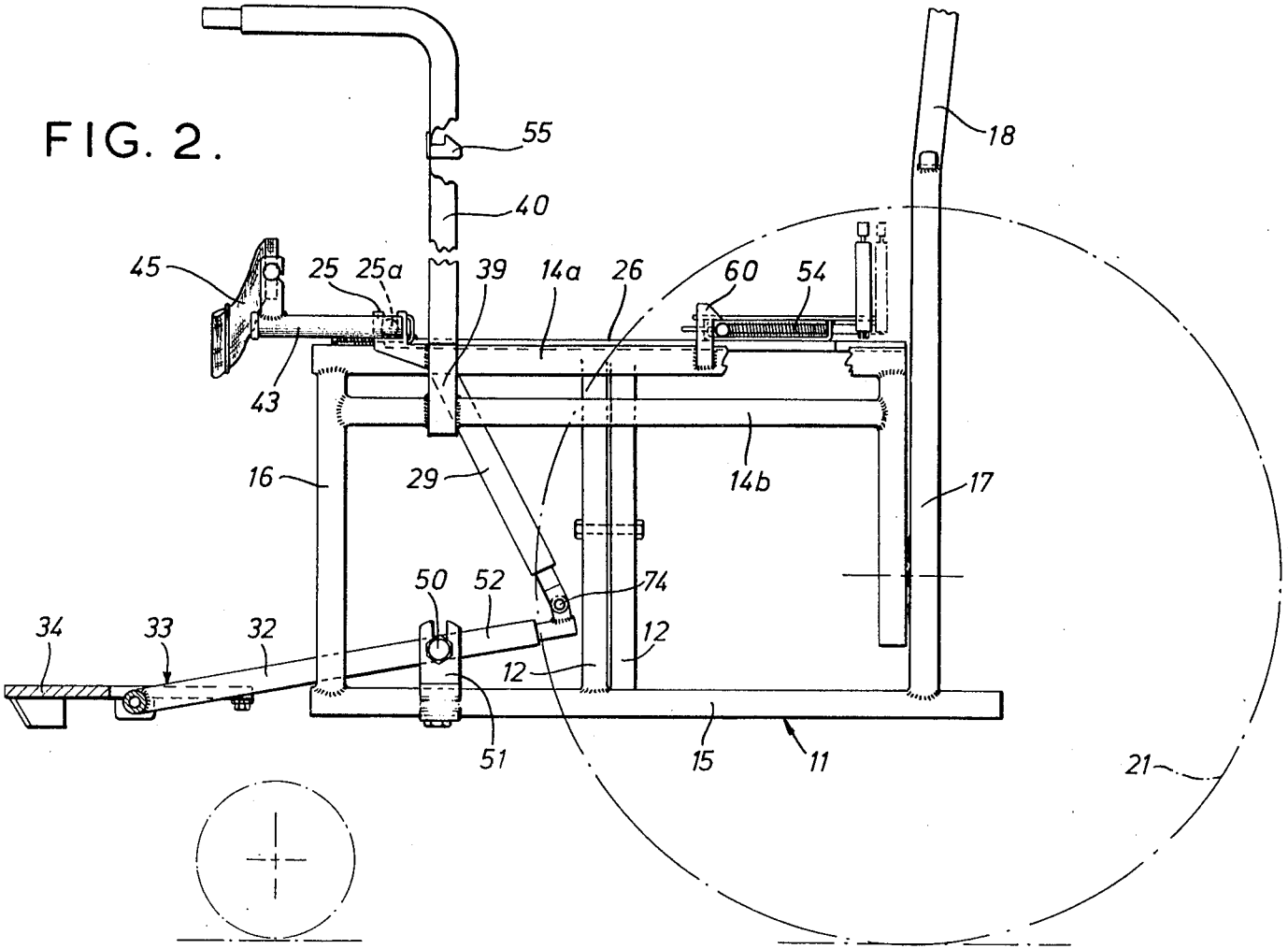
FIG. 2 is a side elevational view showing the frame structure thereof, with parts omitted for clarity, while the seat member is in its normal seating support position.
Figure 3:
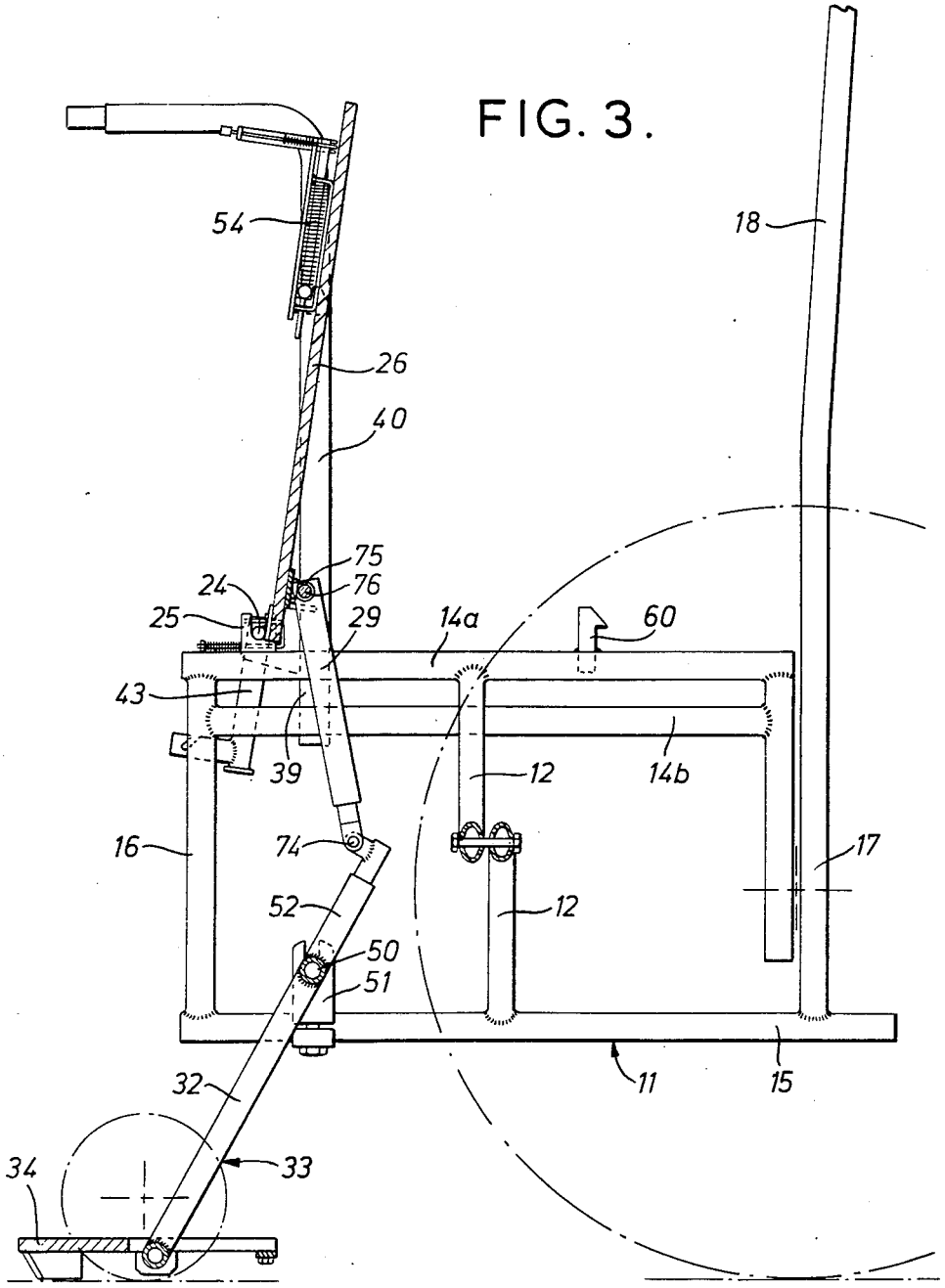
FIG. 3 is a longitudinal vertical section, again with certain parts omitted, showing the seat member in a raised standing support position.

Also, towards the front, the upper horizontal side bars **14*a*, carry projecting slotted brackets 25, 25, which provide a transverse pivot mounting for a seat member 26 which usually lies in a horizontal seating support position. The frame structure as shown in FIGS. 1 and 2 supports seat members 26 when the wheelchair is occupied by a person in a sitting posture. Laterally projecting trunnion pins 24, are fixed to the seat member 26 and engage in the slots of brackets 25 for pivotal mounting. This pivotal mounting enables the seat member 26 to be turned angularly and to be raised upwards into a relatively displaced forwards standing support position, in which it has a substantially vertical back-supporting orientation as shown in FIG. 3**.

A movable foot rest structure 33 comprises a foot-plate member 34 hinged to a sub-frame having a pair of divergent arms 32, integrally connected to a tubular cross-shaft 50. Shaft 50 is pivotally mounted between slotted bearing brackets 51, which are fitted to lower horizontal side bars 15 of side frames 11.

As shown in the drawings, seat member 26 is mechanically coupled to foot rest structure 33 by a single centrally-disposed linkage arm 29. The lower end of arm 29 is pivotally connected at 74 to a short rearwardly directed central arm 52. Cross-shaft 50 integrally carries arm 52. The upper end of arm 29 is pivotally connected at 75 to a cross-bar 76 fixed to the underside of the seat member 26. Cross-bar 76 is at a location adjacent to, but rearwardly of, the trunnion pins 24.

The seat member 26 and foot rest structure 33 are thus interconnected so that they are constrained to maintain predetermined relative positions and to move in unison. In particular, when the seat member 26 is in its normal horizontal seating support position, the foot rest structure 33 is in a raised position with the foot-plate member 34 above the ground (as shown in FIG. 2) at a level appropriate for supporting the feet of a person sitting in the wheelchair. Upon raising seat member 26, however, the foot rest structure 33 is lowered. The lowering of foot rest structure 33 causes seat member 26 to be raised, as a result of the motion transmitted by the interconnecting linkage arm 29. The linkage arm 29 may incorporate suitable length adjstment means. The geometry of the arrangement is set such that the foot-plate member 34 will be at ground level when seat member 26 is in its vertical forwards standing support position as shown in FIG. 3.

Each of the side frames 11 also has a tubular socket 39 in which the ends of a detachable L-shaped handle member 40 can be fitted. When an occupant of the wheelchair wishes to rise to an erect standing position, the handle members 40, provide a pair of upright supports when fitted with the ends of their long limbs spigotted in the sockets 39. However, at other times, handle members 40 are stowed (as shown in FIG. 1) with the ends of their short limbs in the sockets 39 and their long limbs directed rearwards forming said arm rests above the upper horizontal side frame bars 15.

The seat member 26 is adapted to be locked in its raised vertical position. A releasable spring-loaded locking device 54 is fitted at each side of seat 26 and engages a complementary locking detent catch 55 fixed to handle members 40. Catch 55 is operative when the latter are fitted in their vertical positions as will be clear from FIGS. 2 and 3.

The seat member 26 is also locked in its lowered seating support position. Locking devices 54 each engage a detent catch 60 fixed to the upper side bar **14*a* of each side frame 11**.

The seat member 26 also carries a pair of short forwardly projecting arms 43, which provide mountings for releasable transverse strap fittings 44 and 45, as indicated most clearly in FIG. 1. Fittings 44 and 45 are thus mounted securing across the thighs of the chair occupant without interfering with his movement.

The construction described is capable of greatly facilitating, safe, externally unaided, movement of a handicapped person between sitting and standing postures. Thus, a person may sit in the wheelchair when the seat member 26 is horizontal and the foot rest structure 33 is raised. Upon pressing down on the foot-plate member 34 by transferring the weight forwards on to it, the foot rest structure 33 moves to its lowered ground-engaging position. At the same time, seat member 26, constituting body support means, moves angularly forwards and upwards. Thus, the person is eased up with continuous rear support into an erect standing posture on the foot-plate member 33. Before undertaking this operation, the usual brakes of the wheelchair (not shown) are of course applied, the castor wheels are centralized, the locking devices 54 are released, the strap fittings 44 and 45, are secured across the body and/or legs of the person involved, and the handle members 40 are fitted in their upright positions to give aditional steadying support.

Once the erect standing position is reached, the locking devices 54 automatically engage with catches 55. Seat member 26, now functions as a back support in its substantially vertical position and is held in place so that the person will be held quite securely without any effort or use of his arms being needed.

When it is subsequently desired to return to a sitting posture, locking devices 54 are released and seat member 26 is disengaged. Then, the person gently transfers his weight backwards against seat member 26 which moves back to its horizontal position. Foot rest structure 33 rises and the person is progressively returned to the sitting posture. By carefully adjusting the placing of his weight, it is found that the person can readily exercise a close control over the movement throughout the whole operation.

If desired, however, in a modification, "helper" springs could be fitted to bias the linkage to set seat member 26 and foot rest structure 33 to their standing support positions so as to give extra assistance to infirm persons in rising from the sitting posture to the standing position. In returning to the sitting posture, their weight would of course act against such "helper" springs.

Foot rest structure 33 together with the linkage arm 29 and seat member 26 form a self-contained assembly which, as a unit, can be disconnected from the side frames 11, and can then be folded compactly for stowing, during transportation for example. Existing conventional wheelchairs can also in many cases, be fairly readily modified and adapted to receive and to be fitted with this assembly which can be provided in a conversion kit form.

Many modifications may of course be made, within the scope of the invention, in the particular structural details but the description herein given by way of example should suffice for an understanding of the basic features of the invention.

I claim:

1. An assembly for assisting movement of an occupant in changing between sitting and standing postures in an invalid chair having a fixed frame structure, said assembly comprising:

(a) a movable seat member support means, (b) first means movably mounting said seat member support means on said frame structure for movement between a seating support position and a relatively displaced forward standing support position, (c) said first movable mounting means being effective to permit forwards and upwards angular movement of said seat member support means from a substantially horizontal orientation in said seating support position to a substantially upright back-supporting orientation in said relatively displaced forwards standing support position, (d) a movable foot rest structure having a foot plate member, (e) second means movably mounting said foot rest structure for movement between a raised foot-supporting position and a lowered ground-engaging position, and (f) mechanical linkage means operatively interconnecting said seat member support means and said foot rest structure to transmit pressure and motion from one to the other, (g) said foot plate member being maintained in a substantially horizontal orientation during the angular movement of the foot rest structure between the raised foot supporting position and the lowered ground engaging position, (h) hand grip support members detachably mounted to the chair frame structure for assisting and steadying the chair occupant when changing between sitting and standing postures, (i) said seat member seat means being controllable by the chair occupant varying and controlling foot pressure applied to the foot rest structure through shifting and altering his weight distribution and mainipulating said hand grip support members, (j) said seat member support means being effective to move and exert supporting pressure against the body of the chair occupant to assist his movement in changing between a sitting posture in the chair and a standing posture on the foot rest structure.

2. An assembly as defined in claim 1 wherein said first movable mounting means includes pivot means defining a transverse pivotal axis adjacent a front edge of said seat member support means, said second movable mounting means includes pivot means defining a transverse pivotal axis about which the foot rest structure turns angularly in moving between said raised foot supporting position and said lowered ground engaging position.

3. An assembly as defined in claim 2 wherein the foot rest structure includes a foot rest subframe carried by said pivot means, a foot plate member carried by said subrame and means hingedly connecting said foot plate member to said frame member.

4. An assembly as defined in claim 1 wherein the seat member support means, foot rest structure and mechanical linkage means together form a unitary assembly detachably mounted so as to be removable from the chair frame structure as a single foldable unit for stowing during transportation.

5. An assembly as defined in claim 1 wherein releasable locking means are provided to hold the seat member support means locked in said standing support position when the chair occupant has changed from the seating posture to the standing posture thereby to maintain support while the person remains standing independently of his weight distribution.

6. An assembly as defined in claim 1 wherein releasable locking means are provided to hold the seat member support means locked in said seating support position independently of the weight distribution of the chair occupant while he is in a sitting posture.

7. An assembly as defined in claim 1 wherein the hand grip support members are each adapted to be detached and refitted to the chair frame structure in alternative positions, said hand grip support members constitute side arm rests for use by the chair occupant when remaining in a seating posture and vertical upright supports when occupant is in a standing position.

8. An assembly as defined in claim 1 wherein said seat member support means carries forwardly projecting members and restraining strap fittings mounted to said forwardly projecting members, said strap fittings being adapted for securing across the chair occupant to provide additional security when in a standing posture.

9. An invalid chair comprising:

(a) a seat supporting main frame, (b) a mcvable seat member, (c) first means pivotally mounting said seat member on said main frame and including a transversely extending seat pivotal axis adjacent the front of the seat member for angular movement thereabout of said seat member between a substantially horizontal seating position and a substantially upright standing support position;

(d) a foot rest structure including a foot plate member and foot rest carrier frame means connected to said foot plate member, (e) second means pivotally mounting said foot rest carrier frame means on said main frame and including a transversely extending foot rest pivotal axis spaced below the level of the seat member mounting for angular movement of said carrier frame means, (f) said second pivotally mounting means being effective to raise and lower the foot plate member between a raised foot supporting position appropriate for a seated occupant of the chair and a lowered ground engaging position appropriate for a standing occupant, (g) link means including an elongate link pivotally engaged at opposite upper and lower ends with said seat member and with said foot rest carrier frame means, respectively, (h) said link means being effective to operatively interconnect and to constrain said seat member and foot rest carrier frame to move angularly in unison, (i) said foot rest pivotal axis being positioned to provide the foot rest carrier frame means with a forwardly extending relatively long lever arm portion carrying the foot plate member and with a relatively short lever arm portion connected to the lower end of said link, and (j) said seat pivotal axis being positioned in spaced relationship with the upper end of said link, (k) said seat member being controllable by an occupant of the chair by shifting and altering his weight distribution to vary his foot pressure applied to the foot plate member, to move and exert assisting supporting pressure against the body of said chair occupant in changing between a sitting posture in the chair and a standing posture on the foot plate member, (l) hand grip support members which extend upwardly from the main frame, forwardly of the seat pivotal axis and adjacent the front thereof, (m) said hand grip support members being effective to assist and steady the chair occupant enabling the occupant to control the shifting and altering of his weight distribution when changing between sitting and standing postures, and (n) co-operable releasable locking means carried by said hand grip support members and by the seat member operative to hold said seat member locked in its upright standing support position once the chair occupant has reached the standing posture.

10. An invalid chair as defined in claim 9 wherein a back rest structure is fixed to the main frame independently of the seat member, and the seat member, foot rest structure, and interconnecting link means together form a unitary articulated assembly detachably fitted to the main frame by the pivotal mounting means of the seat member and of the foot rest structure so as to be removable as a single foldable unit for stowing during transportation.

11. An invalid chair as defined in claim 10 wherein the main frame includes socket means for detachably fitting the hand grip support members in their upright operative positions, said support members being each adapted to be detached and refitted to the main frame in an alternative position in which they provide side arm rests for use by the chair occupant when remaining in a sitting posture.

12. An invalid chair as defined in claim 9 wherein the main frame includes a pair of interconnected side frames each having an upper side frame member and a lower side frame member, the pivot mounting of the seat member being carried by the upper side frame members of said side frames and the pivot mounting of the foot rest structure being carried by the lower side frame members thereof.

13. An invalid chair as defined in claim 12 wherein latch means is disposed on at least one upper side frame member for cooperating releasably with the locking means carried by the seat member effective to hold the seat member locked in said seating support position independently of the weight distribution of the chair occupant while he is in a sitting posture.

14. An invalid chair as defined in claim 9 wherein the relatively short lever arm portion of the foot rest carrier frame means extends rearwardly of the foot rest pivotal axis and the elongate link extends upwardly with a forwardly directed inclination between said relatively short lever arm portion and the underside of the seat member, rearwardly of the seat pivotal axis, throughout the operative range of angular movement between the seating position and the standing support position.

15. An invalid chair as defined in claim 9 wherein the foot rest structure includes means hingedly connecting the foot plate member to the foot rest carrier frame and stop means limiting angular rotation of the foot plate member, said foot plate member being thereby adapted to be maintained in a substantially horizontal orientation during the angular movement of the carrier frame means when raising and lowering the foot plate member.

16. An invalid chair as defined in claim 9 wherein said set member carries forwardly projecting members restraining strap fittings mounted upon said forwardly projecting members, said strap fittings being adapted for securing across the legs of the chair occupant to provide additional security when in a standing posture.

* * * * *